United States Patent [19]

Novak et al.

[11] 4,200,215

[45] Apr. 29, 1980

[54] COMPRESSION TACKER

[75] Inventors: Raymond F. Novak, Itasca; Richard Doyle, Mt. Prospect; Edmund Frank, Chicago, all of Ill.

[73] Assignee: Duo-Fast Corporation, Franklin Pk., Ill.

[21] Appl. No.: 921,977

[22] Filed: Jul. 5, 1978

[51] Int. Cl.[2] ..... B25C 5/00

[52] U.S. Cl. ..... 227/123

[58] Field of Search ..... 227/109, 123, 107, 120, 227/132

[56] References Cited

U.S. PATENT DOCUMENTS

| | | | |
|---|---|---|---|
| 2,472,032 | 5/1949 | Wandel | 227/123 |
| 2,617,096 | 11/1952 | Boroughs | 227/123 |
| 3,347,439 | 10/1967 | Doherty | 227/123 X |
| 4,087,035 | 5/1978 | Harmon | 227/123 X |

*Primary Examiner*—Paul A. Bell

*Attorney, Agent, or Firm*—Mason, Kolehmainen, Rathburn & Wyss

[57] ABSTRACT

A compression tacker for driving fasteners includes a frame defining a nose portion and a grip portion. A front jaw is pivotally and removably mounted on the nose portion to define a drive track. A plunger is reciprocated in the drive track. The front jaw includes a locking mechanism that upon actuation by the operator of the tool, unlocks the jaw from the frame and allows it to be pivoted relative to the frame to expose the drive track. A handle for actuating the plunger is mounted on the frame and includes a bearing about which a spring is mounted. A workpiece engaging jaw may be removably fastened to the nose portion. The workpiece jaw includes upper and lower surfaces for engaging different workpieces.

33 Claims, 5 Drawing Figures

COMPRESSION TACKER

BACKGROUND OF THE INVENTION

A. Field of the Invention

The present invention relates to a new and improved compression tool for driving fasteners into a workpiece.

B. The Description of the Prior Art

A convenient tool for fastening articles is a hand-held tacker device that may be employed to drive fasteners such as staples into a workpiece. Typical prior art tackers include a magazine that feeds a stick of fasteners such as staples into a drive track whereupon the fasteners are driven by a driver blade into the workpiece. The drive track is of a sufficient dimension to include a plunger that is spring biased into engagement with the fasteners. The drive blade is connected to this plunger and reciprocated therewith.

The typical tool includes a handle that is is pivotally mounted on the housing and serves to engage and compress the spring until a certain force is created whereafter the spring is released allowing it to drive the plunger and the drive blade onto the fastener. A spring is included in the housing to return the handle to its normal at rest position. Typically, in prior art tools, the positioning of the handle in the tool and securing the spring so as to bias the handle to its at rest or normal position is difficult requiring several tools.

Another disadvantage of the typical prior art tool is that if a jam occurs within the drive track of the tool such as for example when the operator tries to drive two fasteners at the same location, the track must be opened or exposed to allow the jammed staples or fasteners to be removed. The typical prior art tacker includes a nose plate or nose portion that is permanently secured to the frame of the tacker or is removably secured in a manner that requires the use of tools. These tools require a substantial amount of time for the operator of the tacker to clear the jam and continue operation.

It is also desirable for tools of this type to include a jaw that may be attached to the frame and used for different workpieces such as, for example, screens, wires, or flat workpieces. Prior tackers include such jaws but each serves a single function and is secured to the tool by the use of fasteners requiring additional tools for removal and replacement.

SUMMARY OF THE INVENTION

An object of the present invention is to provide a new and improved tacker for driving fasteners into a workpiece.

Another object of the present invention is to provide a new and improved tacker that includes an easily operated mechanism for quick removal of jammed fasteners.

Another object of the invention is to provide a new and improved tacker that includes a spring for biasing the handle of the tacker to the normal position that may be easily installed requiring a minimum amount of tools and installation time.

An additional object of the present invention is to provide a new and improved workpiece jaw that may be quickly and easily attached to the housing of the tacker and may be employed for more than one type of workpiece.

The present invention is directed to a new and improved tacker for driving fasteners into a workpiece and particularly, to that type of fastener that is hand held and may be used in the home as well as in the construction industry. The tacker of the present invention includes a frame defining a nose portion and a grip portion intended to be grasped by the user of the tool.

A front jaw is pivotally and removably secured to the nose portion and functions to define a drive track between it and the nose portion. A spring is mounted within the drive track and against the plunger tending to bias the plunger to a fastener engaging position. A driver blade is attached to the plunger and upon the plunger being driven by the spring, engages a fastener driving it into a workpiece. A magazine assembly is secured to the frame for feeding fasteners to the drive track.

The jaw is pivotally attached to the frame at one end and lockingly engages a pin attached to the frame at another end. Through this construction, the operator of the tacker by hitting the upper end of the jaw, causes the jaw to pivot about its pivotal connection moving the locking portion of the jaw out of engagement with the pin and exposing the drive track allowing the user to remove debris from the drive track.

The plunger is driven by compressing the spring until a predetermined amount of force is created and then releasing the spring allowing it to drive the plunger. This is accomplished through the use of a handle pivotally mounted on the frame and including a trip paw that engages the plunger. Through this connection, the handle is depressed, and the plunger is raised compressing the spring. After the spring has been compressed a predetermined amount, the trip pawl releases the plunger allowing it to be moved downwardly within the drive track under the influence of the spring causing the blade to engage a fastener driving it into the workpiece.

The handle includes a spring tending to bias it to an at rest position. The spring is mounted to the handle prior to assembly and upon insertion of the handle into the frame, the spring engages a pin formed on the frame flexing the spring and creating a biasing force.

In a preferred embodiment of the tacker, a workpiece jaw is removably and reverseably mounted on the front jaw and includes two surfaces that may be alternatively selected by the user for engaging different types of workpieces allowing the tool to be used for different purposes.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 4:
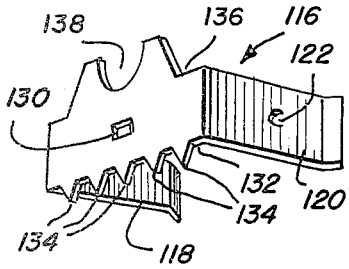
FIG. 4 is a view of the workpiece jaw that may be used with the tool of the present invention.
Figure 5:
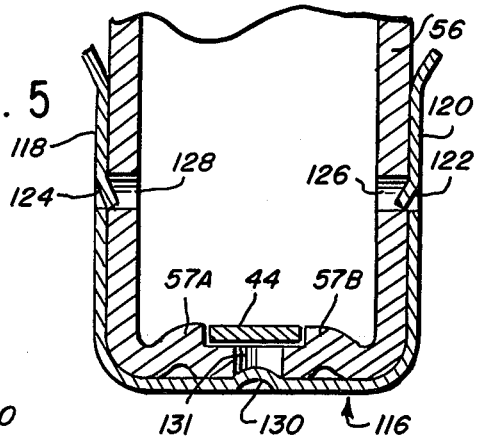
FIG. 5 is a view of the workpiece jaw mounted on the tool of the present invention.
Figure 1:
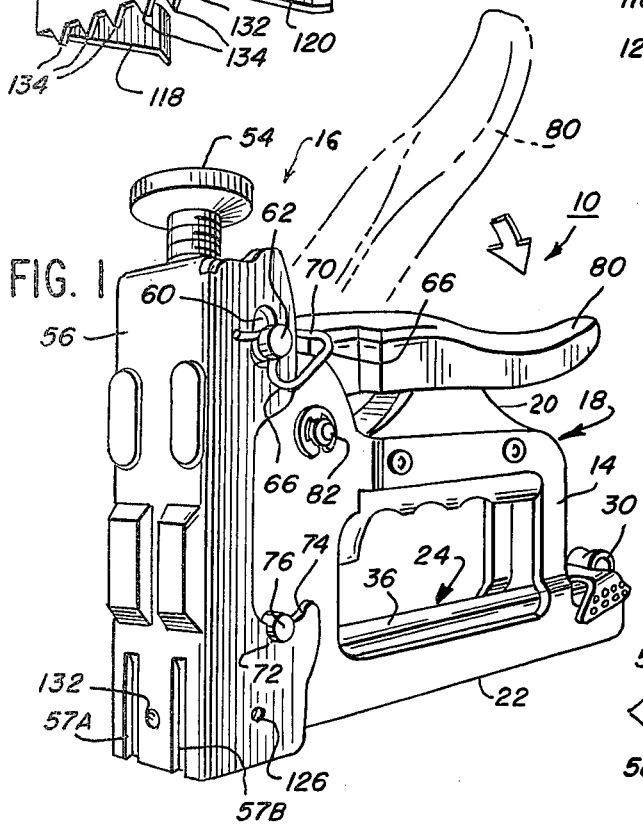
FIG. 1 is a perspective view of a preferred embodiment of a tacker constructed in accordance with the principles of the present invention.

With reference now to the drawings and initially to FIG. 1, there is illustrated a compact, hand-held tacker generally designated by the reference numeral 10. The tacker 10 is intended to be employed both for home and industrial use and is operated by hand to drive a fastener such as the staples 12 into a workpiece. The tacker 10 includes a main frame 14 that defines a nose portion generally designated by the reference numeral 16 and a handle or grip portion 18. To provide a better grip for the operator and also to define a definite stop for a complete driving cycle of the tool 10, a hand grip 20 may be secured to the frame 14.

The lower portion of the frame 14 defines a channel 22 within which a magazine assembly generally designated by the reference numeral 24 may be positioned. The magazine assembly 24 functions to feed the fasteners 12 to be driven by the tacker 10. The magazine assembly includes a pusher 26 mounted within the channel 24 on a pusher rod 28. The pusher rod 28 is removably held within the channel 24 by a pusher lock 30 that includes a hook 32 that may be inserted into a slot 34 defined in a channel cover 36. A spring 38 is mounted around the pusher rod 28 and biases the pusher toward the nose portion 16 of the tacker 10.

To drive the fasteners 12, the tacker 10 employes a plunger 40 that is mounted within a drive track generally designated by the reference numeral 42 and partially defined by the nose portion 16. A drive blade 44 is removably secured to the plunger 40 and reciprocates within the drive track 42. The plunger 40 is biased downwardly by a first spring 48 and a second supplemental spring 46 that are mounted within and biased against the plunger 40. The downward movement of the plunger 40 within the tacker 10 is terminated at a lower position as defined by a bumper 50 that is mounted on a bumper support 52 by a rivet 53. The bumper support 52 is secured by the bumper rivet 53 to a portion of the frame 14.

The springs 46 and 48 are secured at their upper ends to an adjustment screw 54 that is threaded into an aperture in the top of a front jaw 56. Accordingly, the force applied by the springs 46 and 48 may be adjusted by threading the adjustment screw 54 to compress to a greater or lesser amount the springs 46 and 48.

The front jaw 56 defines the front portion of the drive track 42 and with the forward end of the magazine 24, defines the drive track 58 for the driver blade 44.

Since the front jaw 56 is of a greater transverse dimension than the driver blade 44, the lower portion of the jaw 56 includes embossing 57A and B that define the drive track 58 in that portion of the front jaw 56. The front jaw 56 is easily released from its connection with the nose portion 16 so as to allow easy access to remove bent fasteners 12 or other debris from the drive track 58. The front jaw 56 includes an vertically elongated slot 60 through which a pin 62 that passes through the nose portion 16 extends thus allowing vertical and pivotal movement of the front jaw 56 relative to the nose portion 16.

Figure 2:
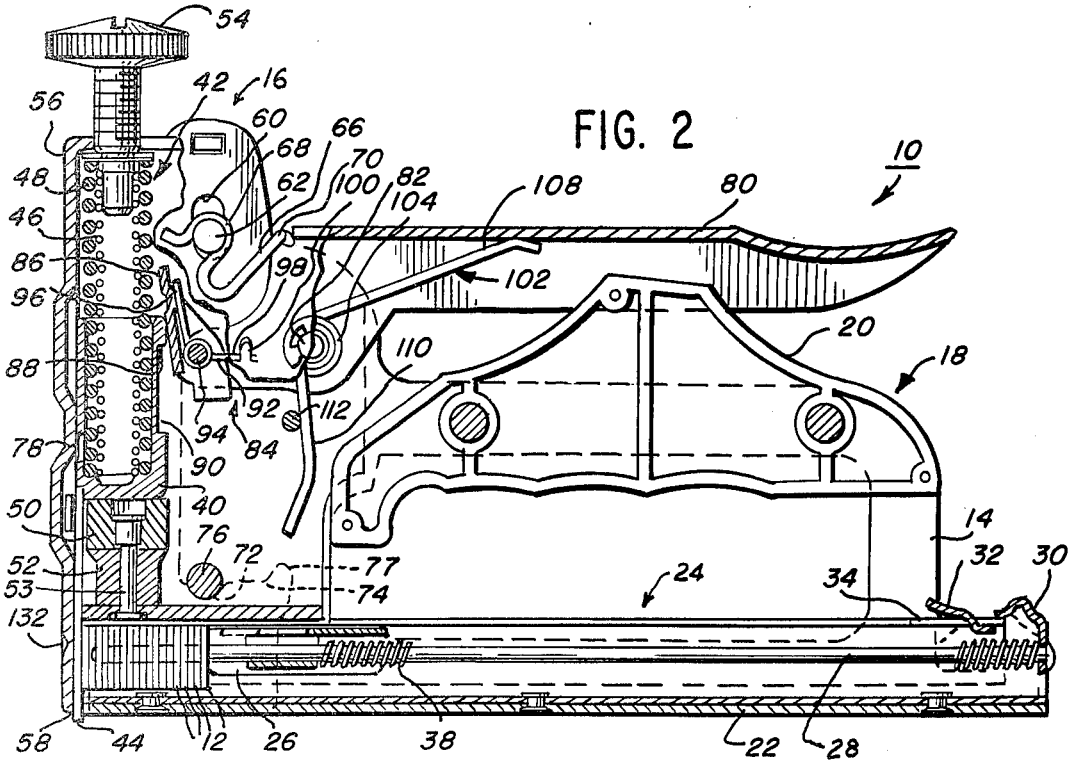
FIG. 2 is a vertical cross sectional view of the tool of the present invention.

The assembly of the front jaw 56 to the nose portion 16 is accomplished by aligning the slot 60 with an aperture (not shown) in the nose portion 16. Thereafter, the pin 62 is inserted through the slot 60 and the aperture. Once this is accomplished, a handle latch 66 is clamped onto the ends of the pin 62 preventing transverse movement of the pin 62 relative to the front jaw 56 and the nose portion 16. The handle latch 66 is a U-shaped bail including curved portions 68 that loop over and latch the pin 62 within the aperture 60. In addition, there is a cross bar portion 70 that connects the two looped portions 68, and as shown in FIG. 2, latches the handle down.

The front jaw 56 is also connected to the tool 10 through the employment of two cam surfaces or locking recesses 72 and 74. In the closed jaw position, the recess 72 is in engagement with a pin 76 secured to the frame 14. The recess 72 is biased into engagement with the pin 76 by the springs 46 and 48 that at one end engage the plunger 40 and at the other end engage the upper portion of the front jaw 56. The net effect is an upward bias of the jaw 56 relative to the frame 14 thus biasing the recess 72 into engagement with the pin 76.

Figure 3:
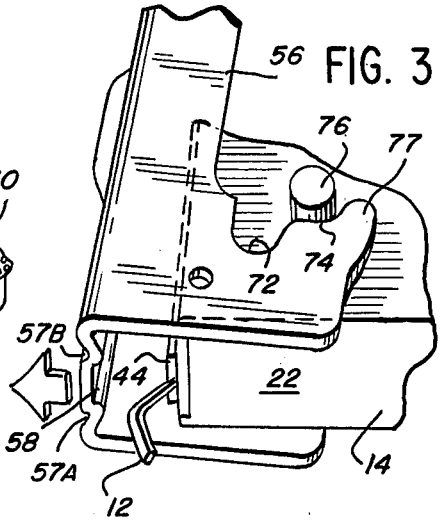
FIG. 3 is a view of the front jaw of the tool of the present invention in the open position.

If the operator of the tacker 10 desired to gain access to the drive track 58 in order to clear a jam, the operator merely needs to push downwardly on the adjustment screw 54. This results in movement of the front jaw 56 against the bias of the springs 46 and 48 moving the slot 60 downwardly relative to the pin 62. As this occurs, the recess or surface 72 is moved downwardly and out of engagement with the pin 76. The front jaw 56 is then pivoted about the pin 62 either due to a bias imparted by the hand of the operator or due to the force of the debris within the drive track 58. As pivoting of the front jaw occurs, the pin 76 moves from the surface 72 toward the surface 74. To prevent movement of the pin 76 beyond surface 74, there is a finger or extension 77 defined on the jaw 56. Once the pin 76 reaches the surface 74, the further pivoting of the front jaw 56 is not possible and the front jaw 56 is held in this position spaced from the end of the magazine 24 and allowing access to the drive track 58 (FIG. 3). Once the jam has been cleared, the operator may push on the front jaw 56, pivoting it about the pin 62. At the same time, the pin 76 moves out of engagement with the recess or surface 74 and into engagement with the recess 72 whereupon the front jaw 56 is again locked in its normal position.

If the jam in the drive track 58 cannot be corrected by pivoting the front jaw 56, the handle latch 66 may be removed from the pin 62 and the pin 62 withdrawn. Thereafter, the front jaw 56 may be removed from the nose portion 16 completely exposing the drive track 58. Since it is undesirable that in this condition the plunger 40 and the driver blade 44 be free and thus able to fall out of the drive track 42, the nose portion 16 includes ears or flanges 78 that are bent at right angles to loosely engage the drive blade 44 and the plunger maintaining them within the drive track 42. Once the tacker 10 has been repaired, the front jaw 56 may again be positioned on the nose portion 16 by aligning the apertures and passing the pin 62 through them. The handle latch 66 is then snapped onto the pin 62.

In order to compress the springs 46 and 48 to drive the plunger 40 through a drive stroke, a handle 80 is pivotally mounted onto the frame 14 through the employment of a pivot pin 82. Resiliently secured to the front end of the handle 80 is a trip pawl 84 that includes a leg 86 that engages an upper edge 88 of a recess 90 defined in the plunger 40. When the handle 80 is at the normal, at rest position (shown in phantom lines in FIG. 1), the trip pawl 84 is biased into engagement with the edge 88 by a pawl spring 92 mounted on a pivot pin 94 that is secured to the handle 80. The spring 92 includes a first leg 96 biasing the leg 86 of the trip pawl 84 into engagement with the edge 88. The spring 92 includes a second leg 98 secured to handle by a tab 100 thus maintaining a constant force biasing the leg 86.

In order to operate the tacker 10, the operator grasps the handle 80 moving it downward into engagement with the grip 20. After a predetermined distance travelled by the pawl 84, it moves out of engagement with the edge 88 releasing the plunger 40 allowing it to be driven under the bias of the springs 46 and 48.

At the completion of the driving stroke, the operator may release the handle 80 and it will be returned to its normal at rest position by a spring 102. The spring 102 is mounted on the pivot pin 82. Prior to the assembly of the tacker 10, the spring 102 is mounted on a bushing 104 and both are mounted about the pin 82. The spring 102 includes a first leg 108 that engages a portion of the handle 80 and a second leg 110 that extends freely from the handle 80 before assembly. During assembly of the tacker 10, the handle 80 with the spring 102 and bushing 104 mounted thereon is inserted into the frame 14. As this occurs, the leg 110 engages a pin 112 secured to the frame 14. The handle 80 is further inserted into the frame 14 until the pin 82 can be passed through the bushing 104 and the frame 14 connecting the handle 80 to the frame. Once assembled, the leg 110 is bent by the pin 112 creating a force in the spring 102 that biases the handle 80 into the upward, normal position. As will be understood, this connection of the spring 102 to the handle 80 allows easy installation of the handle 80 on to the tacker 10.

The tacker 10 may be used for several different workpieces such as screen wire or wire cable by the use of a workpiece jaw 116 that is releasably attached to the front jaw 56 in a position such that one of two workpieces engaging surfaces extends downwardly from the lower portion of the front jaw 56. The workpiece jaw 116 is U-shaped and includes legs 118 and 120 that are adapted to engage and surround the sides of the front jaw 56. On the inner peripheral surface of the legs 118 and 120 are tangs 122 and 124 that are adapted to be inserted into recesses 126 and 128 defined on the outer surface of the locking jaw 56. In addition, a dimple or raised portion 130 is adapted to be inserted within the recess 131 defined on the front surface of the front jaw 56 thus securing the workpiece jaw 116 to the front jaw 56.

The workpiece jaw 116 may be used on two different workpieces due to its easy attachment to the front jaw 56 and its reversible nature. Jaw 116 includes a first surface 132 including teeth 134 that may be used to grasp screens for tacking the screens to a frame. The workpiece jaw 116 also includes a second surface 136 including a recess 138 within which a wire cable may be positioned and a fastener driven around the wire cable connecting it to a workpiece. Consequently, depending on the workpiece in which a fastener is to be driven, the workpiece jaw 116 can be rotated and attached to the front jaw 56 with the desired surface 132 or 136 extending downward to engage the selected workpiece.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A compact, hand-held tacker for driving fasteners into a workpiece comprising a body defining a handle portion and a nose portion,
a plunger mounted in said nose portion,
a driver blade coupled to said plunger,
means for driving said plunger and said blade through a fastener driving stroke,
a jaw pivotally and removably secured to said nose portion, said driving means engaging said jaw to bias said jaw such that said jaw is locked in a first, tool operating position and upon release, is biased to a second, drive track clearing position.

2. The tacker set forth in claim 1 wherein said jaw includes a slot, said body includes a pin extending through said slot to provide a pivotal connection of said jaw to said body, first and second locking surfaces on said jaw, and a second pin on said body engaging said first surface in said tool operating position of said jaw and engaging said second surface in said drive track clearing position.

3. The tacker set forth in claim 1 wherein said jaw includes an embossed drive track.

4. The tacker set forth in claim 1 further comprising a clip on workpiece engaging jaw including means for releasably attaching said workpiece jaw to said jaw.

5. The tacker set forth in claim 4 wherein said workpiece jaw includes first and second workpiece engaging surfaces.

6. The tacker set forth in claim 1 wherein said driving means includes a handle pivotally mounted on said body, a spring mounted on said handle, a pin secured to said body engaging said spring.

7. A tool for driving fasteners into a workpiece comprising a housing defining a grip portion and a nose portion, said nose portion defining a drive path,
a plunger reciprocally mounted in said drive path,
at least a portion of said housing extending around said plunger to hold said plunger in said housing,
a driver blade secured to said plunger,
means for driving said plunger,
a jaw removably secured to said housing defining a drive track for said driver blade between said housing and said jaw,
means for supplying fasteners to said drive track, and
means for allowing release of said jaw from said housing to expose said drive track, said release means including a pivoting and sliding connection of said jaw to said housing and a releasable locking connection of said jaw to said housing.

8. The tool claimed in claim 7 wherein said pivoting and sliding connection comprises a slot parallel to said track defined in jaw and a pin secured to said housing extending through said slot.

9. The tool claimed in claim 7 wherein said locking connection comprising first and second recesses in said jaw and a pin secured to said housing and positioned in said first recess in a tool operating mode and positioned in said second recess upon pivoting of said jaw relative to said housing to a track clearing mode of said tool.

10. The tool claimed in claim 9 wherein said second recess being at a higher elevation on said jaw relative to said first recess.

11. The tool claimed in claim 7 wherein said jaw is mechanically coupled to said driving means to provide a resilient locking force for said locking connection.

12. The tool claimed in claim 7 further comprising a workpiece engagement member releasably secured to said jaw, said engagement member including a first surface defining workpiece engagement teeth and a second surface defining a workpiece engaging recess.

13. The tool claimed in claim 12 wherein said engagement member includes means for removably securing said engagement member to said jaw to allow either of said first or second surfaces to engage said workpiece.

14. The tool claimed in claim 7 wherein said driving means includes a handle pivotally mounted on said housing, a spring mounted on said handle for biasing said handle to a normal, at rest position, and a pin mounted in said housing engaging said spring so as to flex said spring to create a force biasing said handle to said at rest position.

15. A hand-held compression tacker for driving fasteners comprising a main frame defining a handle portion and a nose portion, said nose portion defining a portion of a drive track, a plunger mounted in said drive track, a driver blade secured in said plunger, means for driving said plunger through a drive stroke, and a front jaw pivotally and removably coupled to said nose portion, said front jaw defining a portion of said drive track, said jaw including a slot and said frame including a pivot pin extending through said slot to pivotally connect said jaw to said frame, said frame including a locking pin, said jaw to said frame, locking surface engaging said locking pin during an operating mode of said tool, said jaw including a second locking surface engaging said locking pin upon pivoting said jaw to a clearing track position.

16. The tacker set forth in claim 15 further comprising a workpiece engaging jaw, said workpiece engaging member including means for detachably securing said workpiece engaging member to said front jaw, said workpiece engaging member including a first surface for engaging a first type of workpiece and a second surface for engaging a second type of workpiece.

17. The tacker set forth in claim 15 wherein said driving means includes a handle pivotally mounted on said frame, a bushing secured to said handle, and a biasing member for biasing said handle to a normal position mounted on said housing and abutting a portion of said frame.

18. A compact, hand-held tacker for driving fasteners into a workpiece comprising a body defining a handle portion and a nose portion, a plunger mounted in said nose portion, a driver blade coupled to said plunger, means for driving said plunger and said blade through a fastener driving stroke, a jaw pivotally and removably secured to said nose portion, said jaw adapted to be locked in a first, tool operating position and pivoted to a second, drive track clearing position wherein said jaw includes a slot, said body includes a pin extending through said slot to provide a pivotal connection of said jaw to said body, first and second locking surfaces on said jaw, and a second pin on said body engaging said first surface in said tool operating position of said jaw and engaging said second surface in said drive track clearing position.

19. The tacker set forth in claim 18 wherein said jaw includes an embossed drive track.

20. The tacker set forth in claim 18 further comprising a clip on workpiece engaging jaw including means for releasably attaching said workpiece jaw to said jaw.

21. The tacker set forth in claim 20 wherein said workpiece jaw includes first and second workpiece engaging surfaces.

22. The tacker set forth in claim 18 wherein said driving means includes a handle pivotally mounted on said body, a spring mounted on said handle, and a pin secured to said body engaging said spring.

23. A tool for driving fasteners into a workpiece comprising a housing defining a grip portion and a nose portion, said nose portion defining a drive path, a plunger reciprocally mounted in said drive path, a driver blade secured to said plunger, means for driving said plunger, a jaw removably secured to said housing defining a drive track for said driver blade between said housing and said jaw, means for supplying fasteners to said drive track, and means for allowing release of said jaw from said housing to expose said drive track, said release means including a pivoting and sliding connection of said jaw to said housing and a releseable locking connection of said jaw to said housing, wherein said locking connection comprising first and second recesses in said jaw and a pin secured to said housing and positioned in said first recess in a tool operating mode and positioned in said second recess upon pivoting of said jaw relative to said housing to a track clearing mode of said tool.

24. The tool claimed in claim 23 wherein said pivoting and sliding connection comprises a slot parallel to said track defined in jaw and a pin secured to said housing extending through said slot.

25. The tool claimed in claim 24 wherein said second recess being at a higher elevation on said jaw relative to said first recess.

26. The tool claimed in claim 23 wherein said jaw is mechanically coupled to said driving means to provide a resilient locking force for said locking connection.

27. The tool claimed in claim 23 further comprising a workpiece engagement member releasably secured to said jaw, said engagement member including a first surface defining workpiece engagement teeth and a second surface defining a workpiece engaging recess.

28. The tool claimed in claim 27 wherein said engagement member includes means for removably securing said engagement member to said jaw to allow either of said first or second surfaces to engage with workpiece.

29. A tool for driving fasteners into a workpiece comprising a housing defining a grip portion and a nose portion, said nose portion defining a drive path, a plunger reciprocally mounted in said drive path, a driver blade secured to said plunger, means for driving said plunger, a jaw removably secured to said housing defining a drive track for said driver blade between said housing and said jaw, means for supplying fasteners to said drive track, and means for allowing release of said jaw from said housing to expose said drive track, said release means including a pivoting and sliding connection of said jaw to said housing and a releasable locking connection of said jaw to said housing wherein said locking connection comprising first and second recesses in said jaw and a pin secured to said housing and positioned in said first recess in a tool operating mode and positioned in said second recess upon pivoting of said jaw relative to said housing to a track clearing mode of said tool wherein said second recess being at a high elevation on said jaw relative to said first recess.

30. The tool claimed in claim 29 wherein said pivoting and sliding connection comprises a slot parallel to said track defined in jaw and a pin secured to said housing extending through said slot.

31. The tool claimed in claim 29 wherein said jaw is mechanically coupled to said driving means to provide a resilient locking force for said locking connection.

32. The tool claimed in claim 29 further comprising a workpiece engagement member releasably secured to said jaw, said engagement member including a first surface defining workpiece engagement teeth and a second surface defining a workpiece engaging recess wherein said engagement member includes means for removably securing said engagement member to said jaw to allow either of said first or second surfaces to engage said workpiece.

33. The tool claimed in claim 32 wherein said engagement member includes means for removably securing said engagement member to said jaw to allow either of said first or second surfaces to engage said workpiece.

* * * * *